United States Patent [19]

Bugg

[11] 4,044,172

[45] Aug. 23, 1977

[54] WOOD TREATING PROCESS

[76] Inventor: Kenly C. Bugg, 1202 Sunset Drive, Fort Wayne, Ind. 46807

[21] Appl. No.: 582,703

[22] Filed: June 2, 1975

[51] Int. Cl.[2] ..... B05D 3/06; B05D 3/02; B05D 1/18

[52] U.S. Cl. ..... 427/55; 427/387; 427/393; 427/440

[58] Field of Search ..... 427/55, 387, 393, 440; 21/7

[56] References Cited

U.S. PATENT DOCUMENTS

| | | | |
|---|---|---|---|
| 397,568 | 4/1884 | Cabot | 106/34 X |
| 1,024,531 | 4/1912 | Smith | 106/34 X |
| 1,043,582 | 11/1912 | Faller | 8/6.5 X |
| 1,566,985 | 12/1925 | Shuler | 21/7 X |
| 1,810,659 | 6/1931 | Kritchevsky et al. | 21/7 X |
| 2,398,649 | 4/1946 | Kvalnes | 21/7 X |
| 2,431,148 | 11/1947 | Stover | 21/7 X |
| 2,591,768 | 4/1952 | Austin | 21/7 X |
| 2,867,543 | 1/1959 | Braun | 21/7 X |
| 3,445,265 | 5/1969 | Bentley et al. | 427/387 X |
| 3,512,915 | 5/1970 | Speier | 8/8 |
| 3,685,959 | 8/1972 | Dunn et al. | 21/7 |

FOREIGN PATENT DOCUMENTS

| | | | |
|---|---|---|---|
| 825,551 | 12/1959 | United Kingdom | 427/387 |

*Primary Examiner*—Michael R. Lusignan
*Attorney, Agent, or Firm*—Hume, Clement, Brinks, Willian & Olds, Ltd.

[57] ABSTRACT

Wood is colored both at its surface and interior by coating silicone treating liquid and heating to a temperature above about 170° C to effect color change. The treating liquid, at the coloring temperature, must be sufficiently heat stable so as to maintain the continuity of the coating and substantially inert to the primary constituents of the wood.

14 Claims, No Drawings

WOOD TREATING PROCESS

BACKGROUND OF THE INVENTION

The present invention relates, generally, to a process for treating wood. More specifically, the present invention relates to a process wherein the color and grain of the wood is enhanced without the use of pigments, stains, dyestuffs, and the like.

Many conventional processes and materials are known for the coloring and staining of wood. Typically, the wood is colored by the application thereto of pigments or other dye stuffs which are carried either in solution or as a dispersion or suspension in a liquid vehicle. These conventional processes and materials suffer from a number of disadvantages. Most significantly, the great majority of the prior art wood coloring techniques effect a color change only at the surface of the wood whereby subsequent wear or scratching of the wood makes visible the untreated underlayers. This, in turn, renders such surface blemishes more visible requiring retreatment of the wood in order to maintain a fine finished appearance. In addition, most prior art stains do not provide protection against water and other materials which have a tendency to mark the wood. Accordingly, it is customary to apply to the wood, subsequent to the application of the coloring material, a preservative finish such as varnish, shellac, or a polymeric coating.

Other disadvantages of prior art wood coloring processes and materials include the potential increase in combustability of the wood subsequent to coloring and the toxicity and unpleasant odor of some coloring materials which render the wood treated therewith unsuitable for certain applications.

SUMMARY OF THE INVENTION

It is a primary object of the present invention to provide a process for the coloring of woods, including hardwood, such that the treated wood has a color and finish quality suitable for use in the manufacture of furniture and the like.

It is an object of the present invention to provide a wood coloring technique which is easily controllable and which allows for the consistent and repeated production of a given color from one piece of wood to the next.

It is also an object of the present invention to provide a wood coloring process wherein the wood is colored not only at its surface but uniformly throughout.

Another object of the present invention is to provide a treated wood having a highly desirable surface finish, with a smooth feel that for many uses needs no further treatment or modification.

It is an object of the present invention to provide a finished wood which has improved wear properties and which is more easily polishable.

It is a further object of the present invention to provide a finished wood which will not water-mark and which has increased resistance to fungi and molds.

Still another object of the present invention is to provide a treated wood which is more easily machineable than is untreated wood and whose strength approximates that of untreated wood.

Accordingly, the present invention is directed toward a process for the coloring and treating of wood wherein the wood is coated or wetted on substantially all of its surfaces with a treating liquid and heated to a temperature and for a time sufficient to effect the color change. The treating liquid, at the heating temperature, is sufficiently stable so as to maintain the continuity of the coating and is also substantially inert to the color bearing constituents of the wood. It has been found that treating wood in accordance with this process results in a uniform coloring which, for a given wood specimen, is dependent only upon the time and temperature of the heating step.

DETAILED DESCRIPTION OF THE INVENTION

In accordance with the present invention, wood is colored through the implementation of the following steps:

1. Applying to substantially all surfaces of the wood a coating of treating liquid; and
2. Heating of the coated wood to a temperature and for a time sufficient to effect the color change.

An important aspect of the present invention involves the physical and chemical properties of the treating liquid which is used to coat or wet the surfaces of the wood prior to heating. It has been found that in order to obtain the uniform and consistent coloring of the wood it is necessary that the treating liquid have a sufficient heat stability so as to maintain the integrity of the coating at the heating temperature. In addition, it is also necessary that the treating liquid by substantially inert to the color bearing constituents of the wood at the heating temperature.

The untreated wood used in the present invention should be clean and free from any surface contamination which might interfere with the complete and continuous coating of the treating liquid. No other pretreatment is required and both green or cured wood may be utilized. In fact, one desirable feature of the present invention is that green wood is simultaneously colored and cured in a simple and relatively short process. In addition, the present invention provides satisfactory coloring to any variety of wood, including hardwoods such as oak which heretofore have been difficult to stain.

In accordance with a preferred embodiment of the present invention, the treating liquid comprises a silicone fluid. A number of these polymeric liquids are available from the Dow-Corning Corporation, Midland, Michigan. Particularly, preferred treating liquids include dimethyl siloxane and phenylmethyl polysiloxane, both manufactured by Dow-Corning Corporation under the trade names, Dow-Corning 200 Silicone Fluid and Dow-Corning 710 Silicone Fluid, respectively.

The silicone fluids are suited to use in the present invention since they are available in varieties having both flash points which exceed the ignition temperature of wood and viscosity characteristics suitable for the appropriate coating or wetting of the wood surfaces. In addition, these water-clear liquid polymers are substantially inert, non-toxic, odorless and exhibit low surface tension which helps to assure the complete wetting of all surfaces of the wood.

As mentioned hereinabove, the wood subsequent to being coated with the treating liquid is heated to a temperature and for a time sufficient to effect the color change. It has been determined that the coloring temperature is above about 170° C but below that temperature which would cause ignition or combustion of the wood. Preferably, the wood should be heated to a temperature in the range of about 190° to about 230° C, since it is at these temperatures that rapid color change occurs without danger of thermal degradation to the wood.

The degree of coloring, that is, the degree to which the wood is darkened, or the shade of brown to black imparted in the practice of the present invention is related to the duration of the heating period and the thickness of the wood. For example, a white birch tongue depressor, approximately 1/16 inch in thickness, which has been wetted with a silicone liquid, begins to darken and its grain becomes more readily visible after heating about 1 minute at a temperature of approximately 200° C. Continued application of heat up to a period of approximately 30 minutes, will result in a substantially darkened appearance, and further application of heat up to approximately 2 hours will result in a substantially black appearance similar to that of ebony.

Extremely thin wood strips, such as veneers, will exhibit visible darkening in a matter of seconds when heated in accordance with the present invention. On the other hand, substantially thicker wood pieces will require longer periods of heating. For example, a white ash strip, having a cross-section 1¼ inch square, will show visible and uniform coloring throughout in about 30 minutes and exhibit a substantially darkened appearance in about 1 hour.

Significantly, wood subsequent to having been treated in accordance with the process of the present invention will not evidence thermal degradation, or scorching, at its surfaces, nor will it have suffered any appreciable reduction in strength (i.e., modulus of rupture and modulus of elasticity) form that of the untreated wood. Thus, the coloring process does not appear to affect, in any significant way, the primary structural constituents of the wood.

One preferred method for carrying out the process of the present invention comprises immersing or dipping the wood into a bath of the treating liquid thereby coating substantially all the surfaces thereof and thereafter removing the wood from the treating liquid bath and passing it between parallel rows of infrared radiant heaters. Alternatively, the wood may be heated in an air oven after dipping. This procedure provides one particular advantage in that it may be readily utilized as a continuous process which requires only a relatively small bath of treating liquid.

Another preferred method for carrying out the process of the present invention comprises immersing the wood in a bath of the treating liquid which has been heated to a preselected temperature. In this case, the wetting and heating steps of the process occur almost simultaneously. One advantage to this last mentioned technique is that the treating liquid is impregnated into the wood to a greater degree, thereby enabling the tailoring or modification of other physical properties of the treated wood to meet the requirements of a given application. For example, in the use of silicone treating liquids, the simultaneous dipping and heating technique allows for the impregnation of greater amounts of the silicone. Wood so treated exhibits, in addition to the desired color change, many additional, highly desirable qualities, such as: improved wear, polishability, machineability, and increased resistance to fungi, molds and marking by materials such as water, alcohol and the like.

While the mechanism through which this process provides uniform and consistent coloring is not entirely understood, it is believed that the present invention makes possible the selective volitization or vaporization of certain constituents in the wood and the controlled oxidation of other selected constituents within the wood thereby darkening and enhancing its appearance. More specifically, it is believed that the present invention allows for the volatilization of the secondary or extraneous constitutents of the wood such as the tannins, polyphenols, volatile oils and resins, gums and other complex organic compounds while, at the same time, leaving substantially intact the primary constituents of the wood, such as the cellulose, and hemicellulose, and perhaps the lignen of the wood also. It is theorized that the coating or wetting of the wood's surfaces permits only a controlled and limited flow of the volatilized secondary constituents through the tube-like cell trains of the wood. These secondary constituents, the extraneous or extractive materials, volatilize at a temperature lower than that at which the primary constituents of the wood begin to thermally degrade. Thus, it is believed that the controlled outflow of these volatilized secondary constituents prevents, or at least suppresses, the thermal degradation or oxidation of the primary constituents which typically occurs when the volatilized secondary constituents are free to flow unimpeded through the cell trains of the wood. It is further theorized that sufficient controlled oxidation of the wood occurs so as to produce the desirable color change in the color-imparting constituents thereof. This color change is perhaps comparable to the caramelizing of sugar, for example, or the desirable toasting, rather than burning or scorching, of bread. The controlled "toasting" of the wood is accomplished by the application of heat and may be analagous to the caramelizing of sugar wherein the application of heat effects an alteration of the chemical and physical properties of the sugar to produce a color change.

It is also believed that the coating of the wood enables the maintenance of more uniform temperatures throughout the wood thereby providing uniformity in color change.

It has been found that in order to provide the appropriate control of color change, it is necessary that the treating liquid be capable of maintaining the integrity or continuity of the coating at the heating temperature. This capability is related to the viscosity of the treating liquid, and it has been determined that a minimum viscosity of about 75 centistokes is required at the heating temperature to allow coloring to occur. Optimum control of the coloring process appears to occur where the treating liquid has the preferred viscosity of about 100 to 400 centistokes. Of course, the viscosity of the treating liquid may be higher so long as it is capable of maintaining a continuous coating on the wood surfaces at the heating temperature.

It has also been found that the treating liquid must be substantially inert to th color bearing or primary constituents of the wood. The term inert, in this context, is intended to mean only that the treating liquid does not act as a solvent and thereby interfere with the capability of the wood's primary constituents to develop color. Again the underlying theory is not completely understood, yet is has been found that if a treating liquid is utilized that dissolves the cellulose, hemicellulose and/or lignen, color development does not occur. Moreover, the dissolution of the primary constituents may also result in a rapid degradation in the strength of the wood.

From the foregoing, it will be readily apparent to those skilled in the art that the present invention may be utilized advantageously in a number of ways. For example, furniture pieces may be assembled and thereafter colored as a whole. This will assure uniform coloring of the entire piece in a short and simple process using a minimum of labor. Moreover, since the present invention provides coloring throughout, any surface blemish on the finished furniture piece may be easily removed by light sanding. Veneers may also be colored in accordance with the present invention, either prior to or after mounting on a suitable substrate.

The use of silicone fluids as treating liquids is particularly preferred in the coloring of woods used in the manufacture of furniture, panelling, hardwood and parquet floors, and the like where resistance to wear and watermarking and ease of polishing is desirable. They may also be used advantageously to color woods used to make dinnerware, such as salad bowls and the like, where toxicity and high resistance to solvents are required.

Of course, it should be understood that various changes and modifications to the preferred embodiments of the present invention as described herein will be apparent to those skilled in the art. Such changes and modifications can be made without departing from the spirit and scope of the present invention and without diminishing its attendant advantages. It is, therefore, intended that such changes and modifications be covered by the following claims:

I claim:

1. A process for coloring wood comprising:

applying to substantially all surfaces of the wood a continuous coating of a silicone treating liquid, and heating the coated wood to a temperature above about 170° C. and for a time sufficient to effect a predetermined color change in the wood; said treating liquid having a minimum viscosity of at least 75 centistokes at said temperature and also being substantially inert to the color-bearing constituents of the wood at said temperature.

2. The process of claim 1 wherein said treating liquid is a dimethyl siloxane polymer.

3. The process of claim 1 wherein said treating liquid is a phenylmethyl polysiloxane polymer.

4. The process of claim 1 wherein said coated wood piece is heated to said temperature for a period of time sufficient to effect a desired color change in the color-imparting constituents of the wood but insufficient to effect any significant structural degradation of the primary constituents of the wood.

5. The process of claim 1 wherein said coated wood piece is heated to a temperature in the range between about 190° and 230° C.

6. The process of claim 1 wherein said wood piece is coated with a treating liquid comprising dimethyl siloxane polymer and is heated to a temperature in the range between about 190° and 230° C.

7. The process of claim 1 wherein said coated wood piece is heated to said temperature for a period of time up to about 3 hours.

8. The process of claim 1 wherein said treating liquid has a viscosity between about 100 centistokes and 400 centistokes at said temperature.

9. The process of claim 1 wherein the coating and heating of said wood piece is carried out by immersing the wood piece in a bath of said treating liquid which has been heated to said temperature.

10. The process of claim 1 wherein the wood is coated by immersion in a bath of the treating liquid and the heating of said wood piece is effected after said coated wood piece has been removed from said bath.

11. The process of claim 10 wherein said coated wood piece is heated to said temperature in a hot air oven.

12. The process of claim 10 wherein said coated wood piece is heated to said temperature by radiant heaters.

13. A process for coloring wood comprising:

applying to substantially all surfaces of the wood a continuous coating of a silicone treating liquid, and heating the coated wood to a temperature in the range between about 190° and 230° C. and for a time sufficient to effect a desired color change in the color-imparting constituents of the wood but insufficient to effect any significant structural degradation of the primary constituents of the wood; said treating liquid having a viscosity between about 100 centistokes and 400 centistokes at said temperature and also being substantially inert to the color-bearing constituents of the wood at said temperature.

14. The process of claim 13 wherein said silicone fluid is chosen from the group consisting of dimethyl siloxane polymer and phenylmethyl polysiloxane polymer.

* * * * *

UNITED STATES PATENT AND TRADEMARK OFFICE

CERTIFICATE OF CORRECTION

PATENT NO. : 4,044,172

DATED : August 23, 1977

INVENTOR(S) : Kenly C. Bugg

It is certified that error appears in the above-identified patent and that said Letters Patent are hereby corrected as shown below:

IN THE ABSTRACT:

Line 2, after "coating" insert --with a--

Column 4, line 57, "th" should read --the--

Column 5, line 20, after "where" insert --low--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*